United States Patent [19]

Allen et al.

[11] 4,212,396

[45] Jul. 15, 1980

[54] ENVELOPE ASSEMBLY

[75] Inventors: Robert H. Allen, North Tonawanda; Victor J. Robertson, Niagara Falls, both of N.Y.

[73] Assignee: Moore Business Forms, Inc., New York, N.Y.

[21] Appl. No.: 956,180

[22] Filed: Oct. 31, 1978

Related U.S. Application Data

[62] Division of Ser. No. 809,922, Jun. 24, 1977, Pat. No. 4,166,539.

[51] Int. Cl.[2] ..... B65D 27/34

[52] U.S. Cl. ..... 206/629; 206/632; 229/69

[58] Field of Search ..... 229/69; 206/610, 611, 206/620, 605, 609, 629, 632

[56] References Cited

U.S. PATENT DOCUMENTS

| | | | |
|---|---|---|---|
| 4,002,290 | 1/1977 | Van Malderghem | 229/69 |
| 4,010,889 | 3/1977 | Allen et al. | 229/69 |
| 4,093,074 | 6/1978 | Bielawski | 206/629 |
| 4,166,539 | 9/1979 | Allen et al. | 206/629 |

*Primary Examiner*—Stephen P. Garbe

*Attorney, Agent, or Firm*—Watson, Cole, Grindle & Watson

[57] ABSTRACT

A stuffed, sealed envelope assembly has superimposed front and back plies with insert material within the envelope unattached to the plies so as to be freely disposed therein. At least one cut line or a line of perforations defining a removable portion is provided in one of the envelope plies in the vicinity of an edge of the insert to facilitate opening of the envelope for exposing the insert for extraction. Chip elements, provided for immobilizing the insert within the envelope, underlie the removable portion and are secured thereto so as to be moved away from the insert upon removal (wholly or partially) of the removable portion. An outline of a simulated flap is applied to the outer surface of the one envelope ply so as to overlie or be delimited by the cut line or line or perforations. Other fold lines may be applied to the same outer surface so as to give the impression together with the flap outline of a folded-flap envelope construction. The envelope assembly is therefore capable of being opened for exposing the insert similar to that of a folded-flap construction.

4 Claims, 10 Drawing Figures

ENVELOPE ASSEMBLY

RELATED APPLICATION

This application is a division of U.S. Ser. No. 809,922, filed June 24, 1977 now U.S. Pat. No. 4,166,539.

BACKGROUND OF THE INVENTION

This invention relates generally to a stuffed, sealed envelope assembly of outer plies having an insert freely contained therein, and more particularly to such an assembly which simulates a standard folded-flap construction and is capable of being opened for exposing the insert for extraction in a manner similar to that of a standard folded-flap envelope construction. Means used for immobilizing the insert within the envelope are moved away from the insert upon an opening of the envelope.

Stuffed, sealed envelope assemblies having inserts contained therein are typically opened upon the removal of a tear strip located at one end of the envelope and overlying an end of the insert, the tear strip being defined by superimposed lines of weakening. In several known constructions of this type, the insert is removably attached to the outer envelope plies in some manner and is extracted as the tear strip side of the envelope and a side opposite the tear strip side are grasped and snapped apart whereupon the tear strip is removed and the insert is extracted. Such an envelope construction is shown, for example, in U.S. Pat. No. 3,554,438.

Other stuffed, sealed envelope constructions have inserts freely disposed therein, i.e., the insert material is unattached to any portion of the outer envelope plies. Such a construction is disclosed in U.S. Pat. No. 4,010,889 wherein the "free" insert is immobilized by means of chip elements secured to the outer plies in abutting engagement with marginal edges of the insert material but unattached thereto. Other stuffed, sealed envelope constructions having "free" inserts are shown in U.S. Pat. No. 3,339,827 and in U.S. Pat. No. ;b 3,777,971, the insert in the former being immobilized through peripheral lines of securement of the outer plies and in the latter by means of embossments provided in an outer envelope ply.

Each of the envelopes of the aforementioned "free" insert constructions has a tear strip at one end overlying an end of the insert and being defined by superimposed lines of weakening so that, upon removal of the tear strip, an end of the insert is exposed for extraction, or the tear strip side and a side opposite thereto may be grasped and snapped apart to facilitate insert extraction.

When extracting the insert in the manner aforedescribed, the connecting ties at the lines of perforations connecting the tear strip to the remainder of the envelope must separate upon tear strip removal for the extraction operation to function properly. However, if these connecting ties are made insufficiently keen during production, a clean separation of the tear strip is affected. The insert must then be extracted in a manner not intended for such a stuffed, sealed envelope construction which is not only frustrating but may actually result in some destruction of a portion of the insert.

Also, it has been found that the recipients of these stuffed, sealed envelopes may be unaccustomed to following the necessary instructions to "grasp and snap" or to otherwise remove the tear strip for opening the envelope and extracting the insert. They may have only experienced receiving the normal top or side opening correspondence envelopes in the mails which are of the standard folded-flap envelope variety wherein the folded sealed flap of such construction is of course normally peeled apart by the recipient, or a letter opener or finger is inserted through an unsealed portion thereof for tearing along a fold line of the flap.

SUMMARY OF THE INVENTION

It is therefore an object of the present invention to provide a stuffed, sealed envelope construction which offers the advantages of ease and economy in assembly and permits high speed printing as a continuous connected series of envelopes while at the same time offers the advantages of ease and simplicity and perhaps less confusion for some, as provided by a folded-flap envelope construction in opening such an envelope for extracting its insert.

A stuffed, sealed envelope assembly having a free insert unattached to any portion of the envelope but held in the desired registration position therein, has been modified in accordance with the present invention for carrying out the aforementioned objective. The stuffed, sealed envelope having a "free" insert therein, as for example disclosed in U.S. Pat. No. 4,010,889, particularly lends itself to the present unique manner developed for opening the envelope and exposing the insert for extraction since the insert is unattached to the outer envelope plies and is therefore easily extracted upon opening of the envelope without the need to break any connecting ties between the insert and some part of the envelope.

In carrying out the invention, a stuffed, sealed envelope is constructed as having superimposed outer plies with the insert contained therein in a manner unattached to the plies, means being provided in only one of the plies for opening the envelope and exposing the insert for extraction similarly as in the manner of a standard folded-flap correspondence envelope. At least one cut line is provided in this one envelope ply so as to define a pocket access opening. A plurality of perforations defining access openings may also be provided in this ply. A simulated envelope flap defining a portion of this outer ply overlies an edge of the insert. The cut line and/or the perforations delimit at least a portion of the simulated flap, or are otherwise located at least in part within the confines of the simulated flap. Therefore, upon insertion of an opener through one of the access openings, at least a portion of the simulated flap is separated from the remainder of the envelope upon exertion by the opener of a force causing the separation.

When insert retaining chip elements are utilized to immobilize the insert, as disclosed in U.S. Pat. No. 4,010,889, portions of such chip elements underlying a separable portion of the outer ply may be secured thereto so as to be moved away from the insert upon opening of the envelope so as to avoid any possible interference with the extraction operation.

Various types of perforation lines alone or together with a cut line or cut lines may be provided to facilitate envelope opening, with one or more of such lines outlining a simulated flap, or such a simulated flap overlying one or more of such lines.

DETAILED DESCRIPTION OF THE INVENTION

Figure 1:
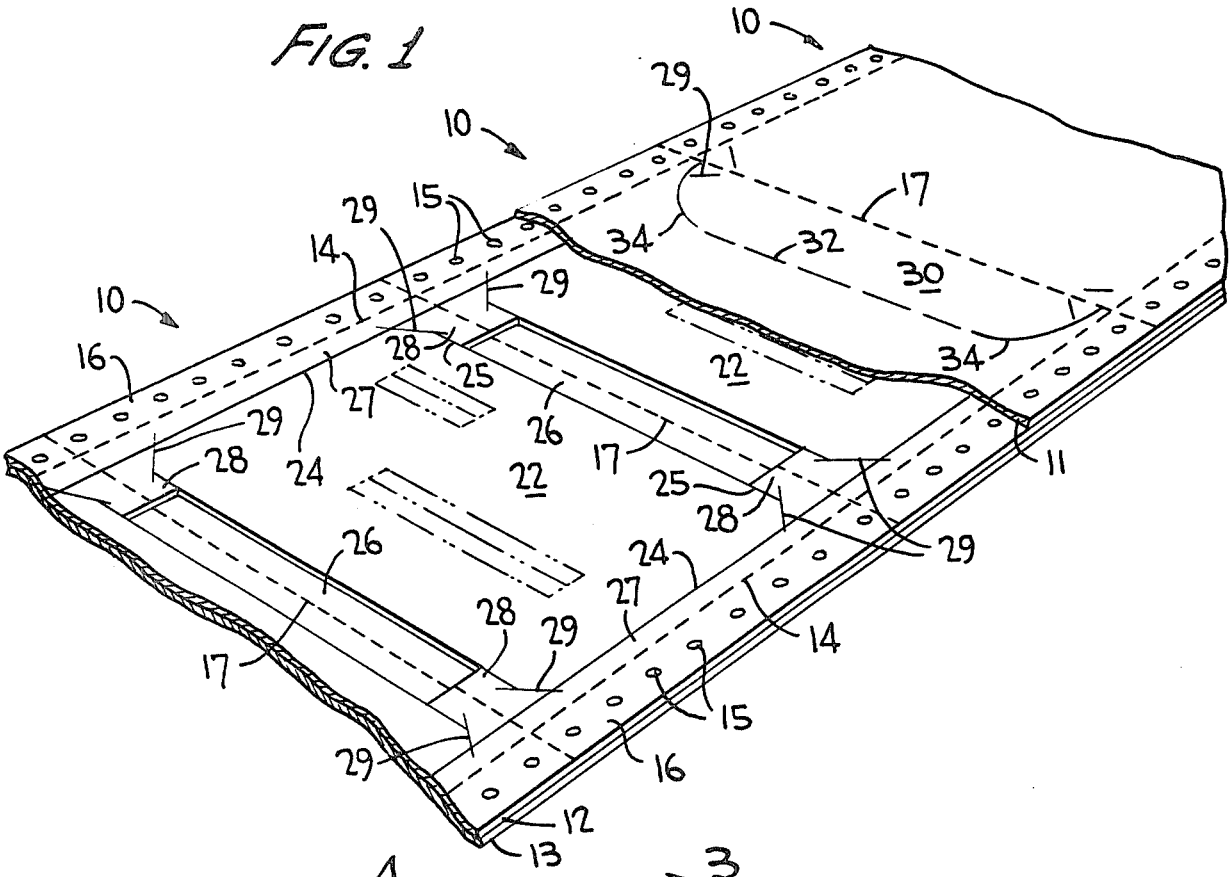
FIG. 1 is a perspective view of a series of connected envelopes constructed in accordance with the present invention with a portion thereof broken away for clarity.

Turning now to the drawings wherein like reference characters refer to like and corresponding parts throughout the several views, a continuous series of connected envelopes each generally designated 10 is shown in FIG. 1 constructed similarly in accordance with the commonly owned U.S. Pat. No. 4,010,889 with the exception of the tear strip disclosed therein. The entire disclosure of U.S. Pat. No. 4,010,889 is therefore specifically incorporated herein by reference as it relates to the assembly of a stuffed, sealed envelope having an insert immobilized therein by means of chip elements attached to the outer envelope plies which abut against edges of the insert but are unattached thereto.

Figure 3:
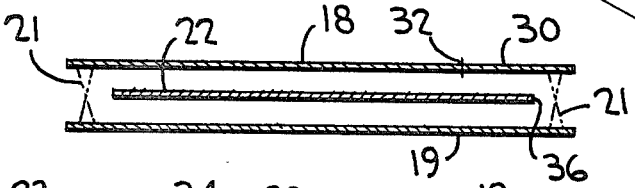
FIGS. 3 and 4 are sectional views taken respectively along the lines 3—3 and 4—4 of FIG. 2.
Figure 4:
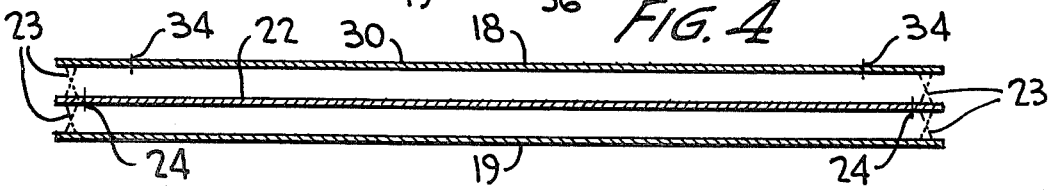

Individual envelope assemblies 10 are constructed of continuous superimposed sheets 11, 12 and 13 having superimposed longitudinal lines 14 of weakening therein near opposite side edges as well as spaced feed holes 15 defining removable feed bands 16. Superimposed transverse lines 17 of weakening separate the sheets into individual envelope assemblies 10 having lower and upper envelope plies 18 and 19 in the form of back and front panels respectively adhesively secured together along portions of their top and bottom by lines 21 of adhesive (FIG. 3) and secured together along the remainder of their periphery via an insert ply 22 as along lines 23 of adhesive (FIG. 4). It should be pointed out that the back panels are designated 18 and are illustrated as uppermost in the drawings for the sake of clarity. It will be seen that the back of the present stuffed, sealed envelope assembly includes the envelope opening means since the back surface of the envelope simulates a folded-flap envelope construction as intended.

A single insert ply 22 is shown disposed within outer envelope plies 18 and 19, although it should be recognized that a plurality of such plies may be so disposed together with one or more return envelopes without departing from the scope of the invention. And, carbon transfer material may be disposed between all or selected portions of the insert parts and plies, or carbonless transfer material may be coated on all or part of the mating surfaces of the insert parts and plies for transferring indicia from upper ply 19 through the assembly.

Plies 22 are constructed from continuous sheet 12 by cutting along longitudinal lines 24 lying just inside lines 14, as well as by cutting along short transverse lines 25 while die-cutting to form cutouts 26 similarly as in the aforementioned '889 patent. Retention chips or elements 27 and 28 are thereby defined in abutting engagement with the shorter side edges and with portions of the longer end edges of the insert ply as shown. Chips 28 remain attached to their respective insert plies and to each other across lines 17 of weakening and, sometime during the assembly process, are severed from their respective insert plies along short diagonal cuts 29 which intersect cut lines 24 and 25. The insert plies are therefore rendered completely free from attachment to any portion of the outer plies.

Figure 2:
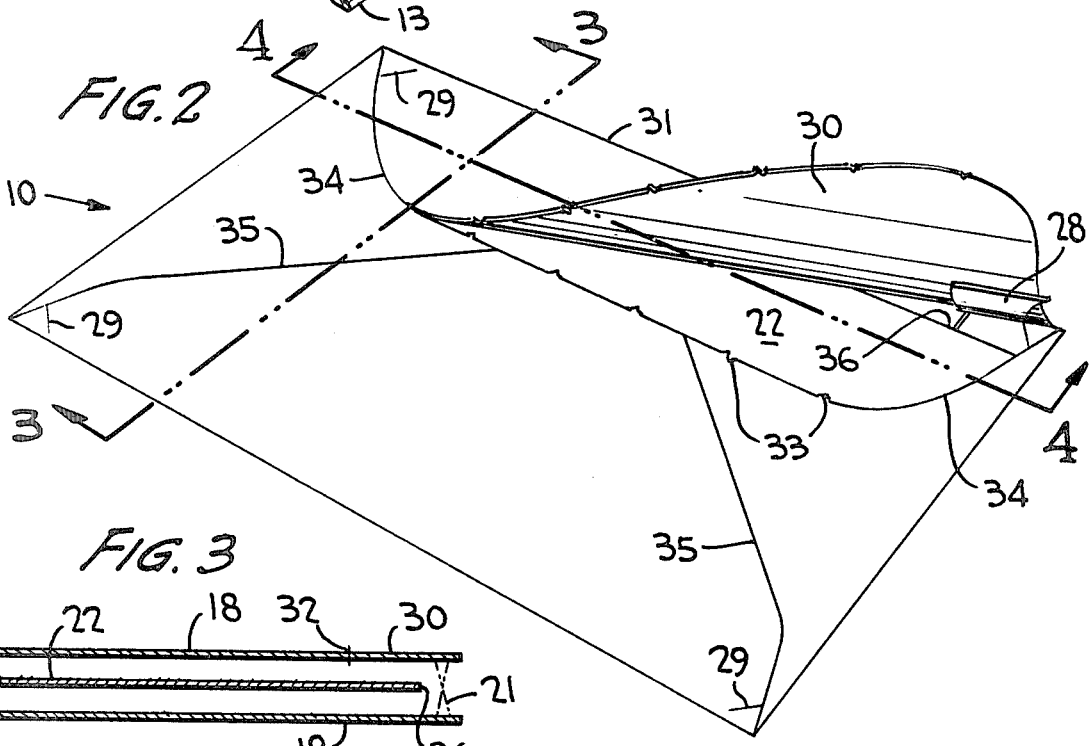
FIG. 2 is a slightly enlarged perspective view of a single envelope assembly separated from the series shown in FIG. 1 and with the feed bands removed, showing the process of opening the envelope in accordance with the invention.

One of the sheets such as 11, from which lower plies 18 are formed, is provided with envelope opening means directly therein for each assembly 10. As clearly shown in FIGS. 2 to 4, means for opening the envelope and exposing insert 22 for extraction comprises a portion 30 of ply 18 extending along a marginal edge 31 of the envelope. Portion 30 is delimited by a line 32 of perforations presenting keen connecting ties 33 (shown broken in FIG. 2), and is further delimited by continuous cut lines 34 extending from opposite ends of line 32 toward marginal edge 31 as shown in FIGS. 1 and 2. Alternatively, portion 30 may be defined by a continuous line of perforations having curved ends. Portion 30 is otherwise secured in place to envelope ply 19 along line 21 of adhesive (FIG. 3). Cut lines 34 are illustrated as slightly curved although they may be straight if desired. And, only one of such cut lines may be provided, the other cut line 34 being replaced by an extension of line 32 of weakening.

Lines 32 and 34 therefore outline a simulated flap extending along marginal edge 31. Lines 35 are applied by inking or in any other normal manner to the outer surface of ply 18 and extend outwardly from line 32 so as to simulate, together with the outline of the simulated flap, a folded-flap envelope construction of a typical top opening correspondence envelope.

Cuts 34 define access openings as well as lift tabs lying in the same plane as ply 18. Accordingly, the stuffed, sealed envelope assembly may be opened upon insertion of the addressee's thumb or forefinger through any one of these cuts so that, as portion 30 is partly lifted it may be separated along line 32 so as to break connecting ties 33 as portion 30 is peeled along this line. It may then be bent upwardly along glue line 21 as shown in FIG. 2 thereby exposing an edge 36 of the insert. A portion of the insert adjacent this edge may then be grasped for extraction of the insert similarly as in the manner of a known folded-flap correspondence assembly. Alternatively, a letter opener may be inserted through one of the access openings defined by such cuts to facilitate breaking of the connecting ties as the opener is moved along line 32, or to facilitate separation of portion 30 from ply 19 as the opener is moved along top line 21 of adhesive at marginal edge 31. Furthermore, portion 30 may be entirely removed upon simply peeling it away after part of it is grasped through one of the access openings and separated along line 32 as well as along top line 21 of adhesive at marginal edge 31, or the addressee may choose to simply tear portion 30 along edge 31 or elsewhere upon grasping portion 30 through one of cuts 34.

In accordance with the invention, those chip elements 28 which underlie portion 30 are secured only to ply 18, or may be more securely connected to ply 18 as compared to ply 19, so that these chip elements will be moved away from insert 22 (see FIG. 2) as portion 30 of ply 18 is peeled open. Therefore, with these underlying chip elements out of the way, an even easier extraction process for the insert is made possible without any interference whatsoever from the chip elements.

Figure 5:
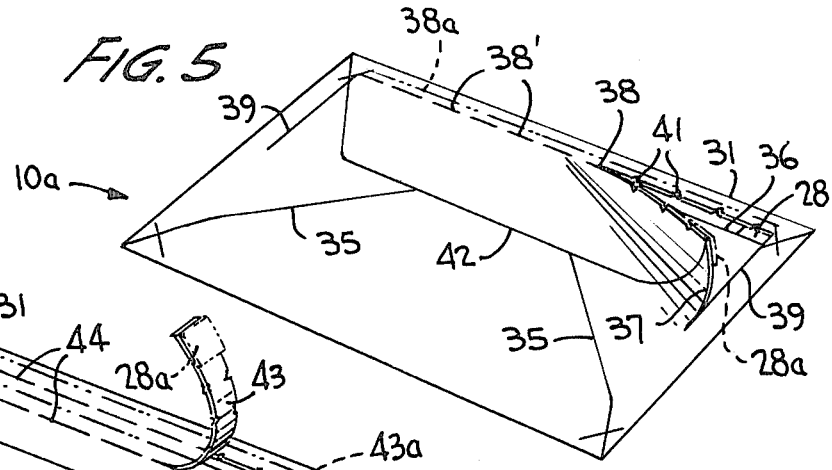
FIGS. 5 to 10 are perspective views of other embodiments according to the invention shown at a slightly reduced scale.

In another embodiment according to the invention, a stuffed, sealed envelope assembly **10*a* shown in FIG. 5 has means for opening the envelope and exposing the insert for extraction which comprises a portion 37** of ply 18 delimited by a line 38 of perforations lying closely adjacent marginal edge 31, and further delimited by continuous cuts 39 located at opposite ends of line 38 and extending inwardly of the envelope as shown. Line 38 of perforations likewise contains a series of keen connecting ties 41 except that such line is disposed outwardly of edge 36 of the insert as compared to inwardly thereto as shown in FIGS. 2 and 5. And, cuts 39 extend away from marginal edge 31 rather than toward it as in FIGS. 2 and 5. Furthermore, in the FIG. 5 embodiment, an outline 42 of a simulated flap extending from marginal edge 31 is printed or otherwise applied to the outer surface of ply 18, and lines 35 are likewise applied to the exterior surface of ply 18 extending from outline 42 so that, together therewith, the back of a folded-flap envelope construction is simulated. Portion 37 of ply 18 in FIG. 5 may lie at least partially within outline 42 and such outline may comprise stippling as shown or lines forming the simulated flap. Also, a line of perforations may be substituted for one or more cuts 39.

Envelope 10*a* of FIG. 5 may be opened upon insertion of the thumb or forefinger or letter opener through either of cut lines 39, or through a cut 38′ of the line of perforations, or through a cut of a line of perforations substituted for cuts 39, to facilitate the breaking of connecting ties 41 as portion 37 is separated along line 38. Of course, portion 37 may be completely removed from the envelope during the opening procedure by simply separating along line 38 and tearing it elsewhere between cuts 39. And, line 38 may lie closer as at 38*a* to marginal edge 31 as shown in FIG. 5, with chip elements 28 underlying portion 37 being attached thereto as at 28*a* so as to be moved out of abutting engagement with insert 22 as portion 37 is moved away from the insert.

Figure 6:
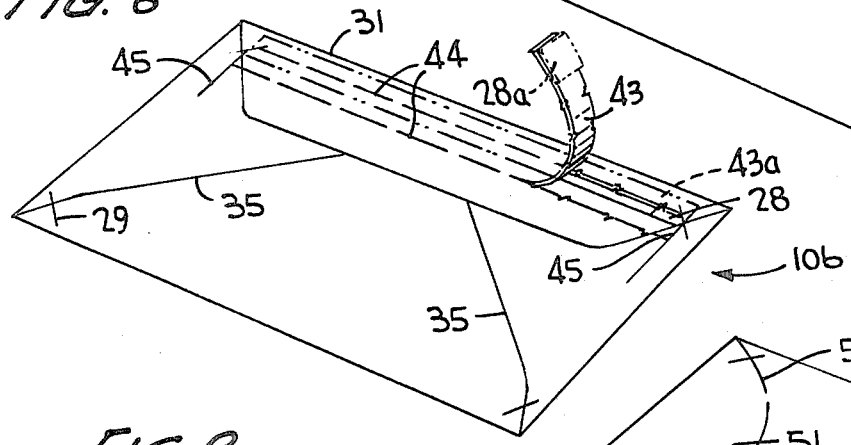

In accordance with another embodiment of the invention, a stuffed, sealed envelope assembly 10*b* is illustrated in FIG. 6 and is constructed in the same manner as all other embodiments except that the means for opening the envelope and exposing the insert comprises a tear strip 43 delimited by a pair of spaced lines 44 at perforations with cut lines 45 connecting lines 44 and located at opposite ends thereof. This tear strip overlies top edge 36 of the insert so that, as it is peeled away as shown in FIG. 6, edge 36 is exposed for removal of the insert. And, similarly as in the FIG. 5 embodiment, tear strip 43 could lie closer as at 43*a* to marginal edge 31 of the envelope so that chips 28*a* would more fully underlie this tear strip and be connected thereto. Removal of the tear strip would accordingly remove chip elements 28 so as to avoid any possible interference presented by such chip elements remaining connected to the other envelope ply during the extraction procedure, similarly as in the FIG. 2 embodiment. And, short lines of perforations may be provided in lieu of cuts 45.

Figure 7:
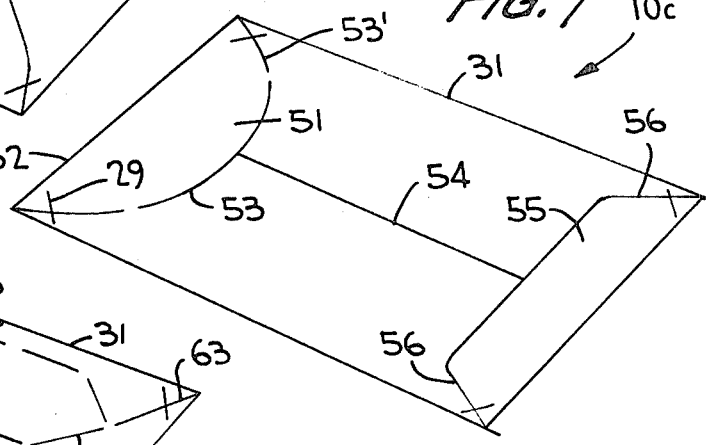

Envelope assembly 10*c* of FIG. 7 is substantially the same as the envelope 10 construction except that a separable side portion 51 is provided in lieu of a separable top portion. This side portion 51 lies along a side marginal edge 52 of the envelope assembly and is delimited by a line 53 of perforations which is partially curved so as to outline a simulated envelope flap. Lines 54, 55 and 56 are applied to the same outer surface of assembly 10*c* so as to simulate together with line 53 a folded-flap side opening envelope construction. Envelope 10*c* is opened in the exact same manner as envelope 10 described with reference to FIG. 2. Retention chips 28 may be secured to portion 51 so as to be moved away from insert 22 upon separation of portion 51, similarly as shown in FIG. 2, and line 53 may be continuously curved, partly curved as shown with straight lines or may be all straight lines defined by a combination of perforations or cuts so long as cuts such as 53′ are defined as access openings.

Figure 8:
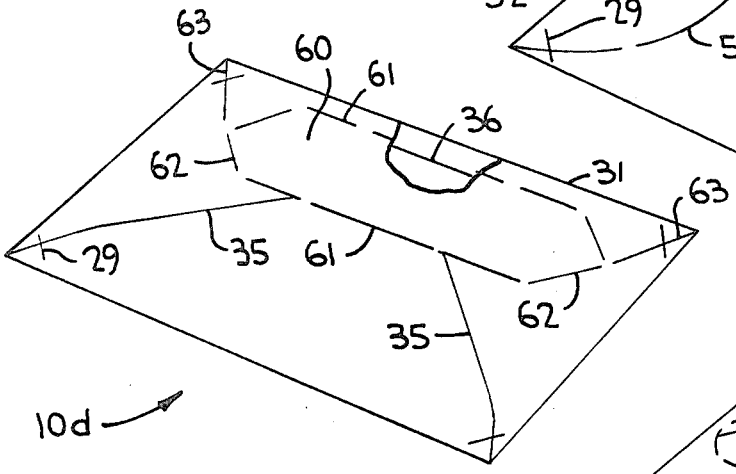

Stuffed, sealed envelope assembly 10*d* of FIG. 8 is quite similar to envelope 10*b* of FIG. 6. A tear strip 60 is provided in an exterior ply of the envelope assembly, such tear strip lying along marginal edge 31 and overlying edge 36 of the insert. The tear strip is delimited by a pair of spaced parallel lines 61 of perforations having substantially V-shaped lines 62 of perforations at opposite ends thereof, and the tear strip may be so disposed as to overlie retention chips 28 (not shown) with the chips being secured thereto so as to be moved away from the insert upon separation of the tear strip, as more clearly shown in FIG. 6. Lines 61 and 62 of perforations define cuts with intervening connecting ties, and such cuts defining access openings through which the operator's thumb or forefinger or a letter opener may be inserted for separating the tear strip along lines 61 and 62, or along marginal edge 31 if desired. Short lines 63 extending from marginal edge 31 and merging with parts of lines 62 are applied to the outer surface of envelope ply 18 for the purpose of outlining together with one of lines 61 a simulated envelope flap. Fold lines 35 are likewise applied to the same outer surface of the envelope so as to give the impression of a folded-flap envelope construction as described with reference to the other embodiments.

Figure 9:
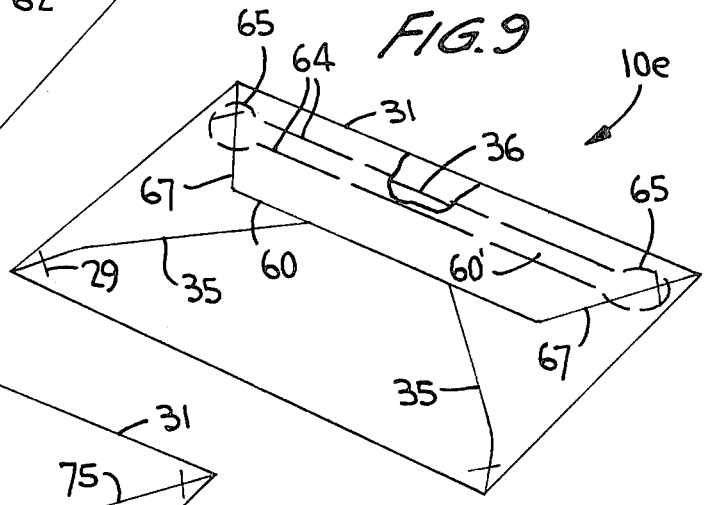

Envelope assembly 10*e* of FIG. 9 is similar to that of FIG. 8 except for the shape of its tear strip 60′. Such a strip is disposed along marginal edge 31 and overlies edge 36 of the insert, and is delimited by a pair of lines 64 of perforations connected at opposite ends by curved lines 65 of perforations. All lines of perforations have cuts with intervening connecting ties, the cut providing access openings for the insertion of a letter opener or some other object such as the operator's finger for facilitating removal of the tear strip along its lines of perforations, or for otherwise tearing the envelope along marginal edge 31 or elsewhere. The tear strip is contained at least in part within lines 66 and lines 67 applied to the envelope for outlining a simulated flap, and retention chips 28 (not shown) may underlie the tear strip and may be secured thereto so as to be moved away from the insert upon removal of the tear strip, similarly as tear strips 43 and 60. Also, other fold lines 35 are likewise applied to the envelope for the same purpose as intended with respect to the other described embodiments.

Figure 10:
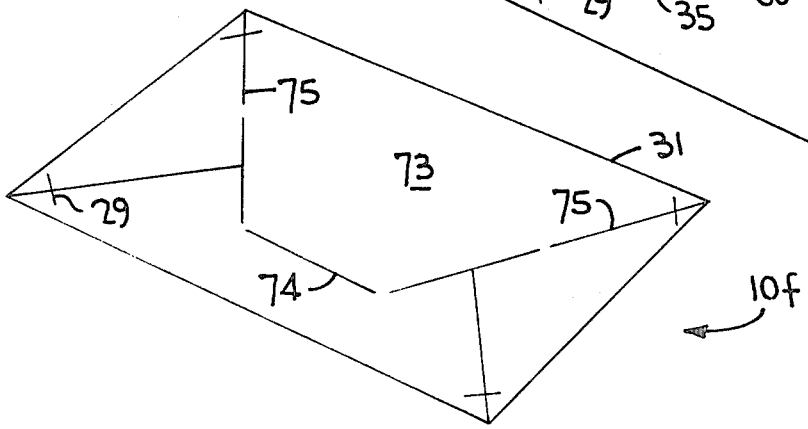

Envelope assembly 10*f* of FIG. 10 is similar to envelope 10 of FIG. 2 except that separable portion 73 is larger by comparison and is defined by straight lines 74 and 75 of perforations. The envelope may be otherwise opened for exposing the insert for extraction similarly as described for envelope 10, i.e., retention chips 28 (not shown) may be secured to portion 73 so as to be moved away from the insert with portion 73.

From the foregoing it can be seen that a stuffed, sealed envelope assembly is constructed in such a manner as to give the appearance of a folded-flap envelope construction openable as any normal folded-flap correspondence envelope. However, at the same time, the present envelope assembly is of the stuffed, sealed variety having a "free" insert therein which facilitates easy and unobstructed extraction of the insert because it is unattached within the envelope and no resistance to easy extraction is therefore offered as by connecting ties in those assemblies wherein the inserts are secured in place in some manner. A simulated flap of the present construction is separated along its line of weakening to thereby open the envelope and expose the insert for extraction. This simulated flap may be partially or totally separated from the envelope or it may be torn along a marginal edge of the envelope with a letter opener or the like. The insert immobilizing means (chip elements) which underlie the simulated flap are moved away from the insert upon opening of the envelope to facilitate easier extraction.

Obviously, many modifications and variations of the invention are made possible in the light of the above teachings. It is therefore to be understood that within the scope of the appended claims the invention may be practiced otherwise than as specifically described.

I claim:

1. A stuffed, sealed envelope assembly, comprising, superimposed front and back plies, adhesive means securing said plies together along marginal edges thereof to form an envelope pocket within the assembly, insert material located within said pocket and being unattached to said plies so as to be freely disposed within said pocket, means including chip elements in abutting engagement with at least one edge of said insert material for maintaining said insert in a desired registration position within said pocket, means lying adjacent one of said marginal edges for opening said pocket and exposing said insert material for extraction therefrom, said opening and exposing means comprising at least one cut line extending through only one of said plies and defining a pocket access opening, said cut line lying near one end of said one insert edge, and said cut line partially delimiting a portion of said one ply which may be separated along said one insert edge from the remainder of said one ply upon insertion of an opener through said access opening, said chip elements underlying said portion of said one ply and being secured thereto, whereby said pocket may be opened and said insert material exposed for extraction therefrom as said portion is separated along said one insert edge from said remainder of said one ply upon exertion by the opener of a force causing the separation after the opener is inserted through said access opening, said chip elements being moved away from said insert upon the separation of said portion.

2. The envelope assembly according to claim 1, wherein said opening and exposing means comprises a plurality of perforations including said cut line and extending along said one insert edge between opposite ends thereof, said perforations extending through said one ply and defining pocket access openings thereby permitting said portion to be separated from said remainder of said one ply upon insertion of the opener through one of said access openings.

3. The envelope assembly according to claim 2, wherein said perforations outline a simulated fold flap capable of being separated from said remainder of said one ply as a conventional fold flap envelope, flap lines applied to an outer surface of said one ply and extending away from said simulated flap outline so that said flap lines together assimilate a folded-flap construction.

4. An assembly formed of superimposed, continuous sheets having spaced transverse lines of weakening defining a succession of interconnected sealed envelopes, comprising: front and back panels; adhesive means securing said panels together along marginal edges thereof to form an envelope pocket; insert material located within said pocket and being unattached to said panels so as to be freely disposed in said pocket; means including chip elements in abutting engagement with at least one edge of said insert material for maintaining said insert in a desired registration position within said pocket, means lying adjacent one of said marginal edges for opening said pocket and exposing said insert material for extraction therefrom, said opening and exposing means comprising at least one cut line extending through only one of said panels and defining a pocket access opening, said cut line lying near one end of said one insert edge, and said cut line partially delimiting a portion of said one panel which may be separated along said one insert edge from the remainder of said one panel upon insertion of an opener through said access opening, said chip elements underlying said portion of said one panel and being secured thereto, whereby said pocket may be opened and said insert material exposed for extraction therefrom as said portion is separated along said one insert edge from said remainder of said panel upon exertion by the opener of a force causing the separation after the opener is inserted through said access opening, said chip elements being moved away from said insert upon the separation of said portion.

* * * * *